US006929534B2

(12) United States Patent
Miyazawa

(10) Patent No.: US 6,929,534 B2
(45) Date of Patent: Aug. 16, 2005

(54) POLISHER AND POLISHING METHOD

(75) Inventor: Makoto Miyazawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/451,381

(22) PCT Filed: Jan. 4, 2002

(86) PCT No.: PCT/JP02/00002

§ 371 (c)(1),
(2), (4) Date: Jun. 23, 2003

(87) PCT Pub. No.: WO02/055261

PCT Pub. Date: Jul. 18, 2002

(65) Prior Publication Data

US 2004/0043710 A1 Mar. 4, 2004

(30) Foreign Application Priority Data

Jan. 5, 2001 (JP) ..... 2001-000677

(51) Int. Cl.[7] ..... B24B 1/00
(52) U.S. Cl. ..... 451/41; 451/529; 451/921
(58) Field of Search ..... 451/41, 42, 56, 451/277, 527, 529, 538, 539, 921

(56) References Cited

U.S. PATENT DOCUMENTS 4,111,666 A * 9/1978 Kalbow ..... 51/295
4,733,502 A * 3/1988 Braun ..... 451/42
4,788,798 A * 12/1988 DeFranco et al. ..... 451/538
5,212,910 A * 5/1993 Breivogel et al. ..... 451/530
5,489,233 A * 2/1996 Cook et al. ..... 451/41
6,500,054 B1 * 12/2002 Ma et al. ..... 451/56
6,527,632 B1 * 3/2003 Dooley et al. ..... 451/504

FOREIGN PATENT DOCUMENTS

JP 5-212669 A 8/1993
JP 8-216029 A 8/1996
JP 10-71561 * 3/1998
JP 11-77503 A 3/1999

* cited by examiner

*Primary Examiner*—M. Rachuba
(74) *Attorney, Agent, or Firm*—Sughrue Mion, PLLC

(57) ABSTRACT

A polisher for polishing a curved surface such as a concave surface of a spectacle lens has a structure in which a polishing pad 3 comprising water passing grooves 5 having a width W of 0.1 to 5 mm is adhered to a dome-shaped elastic base member 2. The polishing pad 3 is composed of a plurality of pads 31, and the water passing grooves 5 are formed at the gaps between the pads 31, whereby the width W of the water passing grooves 5 are made small. It is effective to make the pads 31 polygonal in shape. The polishing pad 3 covers the moving region 6 of the work 8 to be polished. The polishing pad 3 is adhered through a high-tack adhesive layer 4. A polishing method is adopted in which such a polisher 1 is used and the work 8 is polished by pressing the polishing pad 3 against the work 8, whereby the polishing pad 3 adhered to the elastic base member 2 can be prevented from being stripped by an end edge of the work 8, and generation of defective polish can be prevented.

19 Claims, 7 Drawing Sheets

(a)

(b)

(a)

(b)

POLISHER AND POLISHING METHOD

This is a National stage entry under 35 U.S.C. § 371 of PCT Application No. PCT/JP02/00002 filed Jan. 4, 2002; the above noted application is hereby incorporated by reference.

TECHNICAL FIELD

The present invention relates to a polisher and a polishing method, and particularly to a polisher and a polishing method suitable for smoothing or mirror finishing a curved surface of a lens or the like.

BACKGROUND ART

Conventionally, a method of producing a plastic spectacle lens has been conducted by polishing an unpolished spectacle lens which is generally called a semi-finished lens and has a thickness greater than a finished size, as described in Japanese Patent Laid-open No. sho 47-14776. The semi-finished lens is fixed to a holding means for polishing by use of a low melting point alloy generally called "alloy", the surface on the eyeball side (concave surface side) of the semi-finished lens fixed to the holding means is roughly ground in a spherical surface or a toric surface shape according to the prescription for the wearer, and is then subjected to sanding, which is similar to lapping, and to mirror surface polishing, whereby the optical surface of the lens is finished in precision.

In the sanding and polishing, a hard polishing dish made of aluminum, a hard plastic, foamed polyurethane or the like and having a curved surface shape is used. In addition, according to the purpose of processing, a polishing pad of a different kind is adhered to the surface of the hard polishing dish, and sanding and polishing are conducted. In concrete, the purpose of the sanding is to smoothen the roughly ground surface to a certain degree of surface roughness, and to grind off shape errors generated upon rough grinding so as to conform to the shape of the hard polishing dish. The sanding is conducted by a method in which a polishing pad for sanding called "fining pad" and holding on the surface thereof abrasive grains of silicon dioxide, aluminum oxide, silicon carbide or the like about 10 to 20 $\mu$m in grain diameter is adhered to the surface of the polishing dish, and sanding is conducted while pouring water. Though depending on the roughly ground condition, the sanding is generally conducted in two or more stages until a surface roughness in terms of Rmax of equal to or less than 10 $\mu$m is finally obtained.

The purpose of the subsequent mirror surface polishing is to further smoothen the sanded surface and to finish to a desired optical surface. The polishing is conducted by a method in which a polishing pad for polishing formed of nonwoven fabric is adhered to the surface of the polishing dish used in the sanding or a polishing dish of the same shape as the polishing dish used in the sanding, and polishing is conducted while supplying a slurry including abrasive grains dispersed in a dielectric liquid.

FIG. 5 shows a mirror surface polishing method using a polishing dish. FIG. 5(*a*) is a general side view showing the condition where a concave surface of a lens is polishing by use of the polishing dish, and FIG. 5(*b*) is a top plan view of the polishing dish. As shown in FIG. 5(*b*), a petal-shaped polishing pad 100 having a petal shape is adhered to the surface of a dome-shaped polishing dish 110 by utilizing an adhesive provided on the back side of the polishing pad 100. Most of polishing pads 100 commercially available for polishing a plastic spectacle lens each have a petal shape comprising a circular pad provided with radial notches 101 so as to conform to the curved surface shape of the dome-shaped polishing dish 110. As shown in a sectional view of FIG. 6, the commercially available polishing pad 100 has a structure in which a low-tack adhesive layer 105 is provided on one side of a nonwoven fabric 103, with a primer layer 104 therebetween. The polishing pad 100 is adhered to the polishing dish 110 by utilizing the low-tack adhesive layer 105. The polishing pad 100 covers substantially the surface of the polishing dish 110. As shown in FIG. 5(*a*), polishing is conducted by fixing the convex surface of a lens 8 as a work to a work fitting portion 10 through a joining member 9 such as a low melting point alloy, pressing the polishing dish 110 against the concave surface of the lens 8, rotating the polishing dish 110, and rotating and oscillating the lens 8 through the work fitting portion 10.

In recent years, however, high value added lenses in which the surface on the eyeball side of a spectacle lens is provided with an axially symmetric non-spherical surface, a non-spherical astigmatism surface, a progressive surface, a composed surface of a toric surface and a progressive surface, or the like have come to be produced. In the cases of these so-called free curved surface shapes, it is impossible to continuously rub the entire surface of the lens by use of a solid polishing dish having a convex surface in the same shape as the concave surface of the lens.

Therefore, the polishing dish 110 shown in FIG. 5 is changed to an elastic base member having a curved surface shape, the polishing pad 100 with the petal shape shown in FIG. 5 is adhered to the elastic base member to form an elastic polisher, the elastic polisher and the lens are rubbed against each other while pressing the elastic polisher against the concave surface of the lens, and the above-mentioned slurry is intermediately provided, whereby mirror surface finishing is performed. Since the elastic base member can be rubbed against the lens while deforming following up to the concave surface shape, it is possible to polish a free curved surface. As an example of the method of polishing following up to the work shape in this manner, there may be mentioned the method disclosed in Japanese Patent Laid-open No. Hei 8-206952.

In the case of using such an elastic polisher, the size of the elastic base member 2 is much larger than that of the polishing pad 100 which is roughly equal to the lens 8 in diameter, as shown in FIG. 7. The reason is that, since the polishing speed of the elastic polisher is lower than that of the hard polishing dish, it is necessary to enhance the circumferential speed so as to enhance the polishing speed. Therefore, the outside diameter of the polishing pad 100 is much smaller than that of the elastic base member 2, and, in order to cover the moving region 6 of the work 8, the polishing pad 100 is adhered in the state of being eccentric with respect to the center of the elastic base member 2, as shown in FIG. 7.

However, a polishing method using an elastic polisher obtained by adhering a conventionally commercialized polishing pad 100 for polishing a plastic spectacle lens to the surface of the elastic base member 2 has the following problems:

The polishing pad 100 is generally of the so-called disposable type such that the polishing pad 100 is replaced with a new one each time one work is processed. In addition, since the polishing pad 100 is presumed to be used by being adhered to the hard polishing dish, the adhesive force is set to be low taking into account the workability at the time of stripping. Namely, it suffices for the adhesive force to endure at least one polishing step. Therefore, where this type of polishing pad 100 is adhered to the elastic base member 2, the lowness of the adhesive force leads to the following problems.

First, as shown in FIG. 7, at the time of polishing by relative movements of the lens 8 and the elastic base member 2 while pressing the elastic base member 2 against the lens 8 at a predetermined polishing pressure, the elastic base member 2 is deformed by being pushed by the circumferential edge of the lens 8, so that the sharp circumferential edge of the lens 8 may easily get under the notch portion 101 or end edges of the polishing pad 100 having the petal shape. Therefore, the circumferential edge of the lens 8 will easily get between the polishing pad 100 and the elastic base member 2, to strip the polishing pad 100. Besides, since the adhesive force is low, the polishing pad 100 cannot follow up to the deformation in shape of the elastic base member 2, whereby the polishing pad 100 is stripped in many cases.

When even a part of the polishing pad 100 is stripped, the polishing pad in the stripped part is folded, resulting in that the polished surface of the optical component part is scratched, a desired appearance quality cannot be obtained in most cases, and defective polish is generated. Therefore, it is difficult to polish stably under the condition where durability to polishing is thus low.

Further, in order to regenerate the polishing pad which is partially stripped from the elastic base member during polishing, it is necessary to re-adhere the polishing pad and the elastic base member with an adhesive.

The present invention has been made in consideration of the above-mentioned situations. Accordingly, it is an object of the present invention to provide a polisher such that a polishing pad adhered to an elastic base member is not easily stripped during polishing and defective polish is not generated.

It is also an object of the present invention to provide a polishing method using a polisher such that a polishing pad adhered to an elastic base member is not easily stripped during polishing and defective polish is not generated.

DISCLOSURE OF INVENTION

As a result of earnest investigations conducted in order to attain the above object, the present inventor has found out that in the conventional polishing pad with the petal shape, the width of the notch portions is large and the notch portions where the polishing pad is absent are comparatively lower in stiffness than the portions where the polishing pad is present, so that the circumferential edge of the lens will easily get under the notch portions during polishing, resulting in that the polishing pad is stripped. It has also been found out that the notch portions are necessary for polishing as water passing grooves having the functions of discharging the polishing chips, supplying the polishing liquid and so on, and when the water passing grooves are reduced in width than in the prior art, concretely, reduced in width to 0.1 to 5 mm, it is possible to effectively prevent the circumferential edge of the lens from getting under the notch portions and to prevent the polishing pad from being stripped.

In order to obtain a polishing pad with the water passing grooves reduced in width, a plurality of pads are used, whereby it is possible to obtain a polishing pad in which the curved surface of an elastic base member is covered with the pads while reducing the gaps between the pads (water passing grooves). By making the pads to have a polygonal shape, it is possible to reduce the gaps by setting the sides of the polygonal pads close to each other. It is also possible to reduce the gaps by disposing pads so as to partially fill the wide notch portions of the conventional polishing pad having the petal shape.

Further, it has been found out that it is preferable to set the region where the polishing pad is provided on the surface of the elastic base member so as to cover at least the region where the work is brought into rubbing at the time of polishing the work. With such an arrangement, there is no end edge of the polishing pad under which the circumferential edge of the lens will get, and the effect of preventing the stripping of the polishing pad is further enhanced.

In addition, by adhering the polishing pad to the elastic base member by use of a high-tack adhesive having a 180° peel strength according to JIS Z 0237 of equal to or more than 1000 g/25 mm, the stripping or the like of the polishing pad by the circumferential edge of the lens can be effectively prevented. In this case, the high-tack adhesive may be provided on the primer layer and the low-tack adhesive layer provided on the conventional polishing pad.

By making the elastic base member have a curved surface shape, the property of following up to the curved surface of the work can be enhanced. Further, by composing the elastic base member of an elastic sheet, it is possible to follow up to the work surfaces having various shapes by controlling the pressure inside the elastic base member.

As a polishing method, there can be adopted a method in which the polisher according to the present invention is used and a polishing pad provided on the surface of an elastic base member of the polisher is pressed against the work surface. By composing the elastic base member of an elastic sheet, it is possible to follow up to the works having various shapes by controlling the inside pressure for pressing the elastic sheet.

BEST MODE FOR CARRYING OUT THE INVENTION

Now, a mode for carrying out the polisher and the polishing method according to the present invention will be described below, but the present invention is not limited to the following mode.

The work as an object of the polisher and the polishing method according to the present invention is not specially limited and may be any one that has a work surface needing smoothing or mirror surface finishing. The polisher and the polishing method according to the present invention may be applied to polishing of a plain surface, a convex surface or a concave surface, preferably polishing of a concave surface. For example, optical lenses represented by camera lens, telescope lens, microscope lens, focusing lens for stepper, spectacle lens, etc., glass mold for casting polymerization of a plastic lens, and optical component parts such as a cover glass of a portable apparatus, etc. may be mentioned as examples of the work. Hereinafter, description will be made of a plastic spectacle lens as a representative of the work.

The concave surface (on the eyeball side, also called inside surface) of the plastic spectacle lens is provided with a spherical surface, a rotationally symmetric non-spherical surface, a toric surface, a progressive surface, or a composed curved surface of these, or the like. On the other hand, the convex surface of the plastic spectacle lens is provided with a spherical surface, a rotationally symmetric non-spherical surface, a progressive surface or the like. In most cases, the convex surface is formed by transfer of a mold at the time of casting polymerization of a semi-finished lens. The shape of the concave surface is, in many cases, formed by numerically controlled or the like cutting or grinding of a semi-finished lens. After the shaping processing, the shaped surface must be turned to be a desired optical surface by mirror surface polishing.

The polisher according to the present invention is applicable to smoothing or mirror surface finishing of a curved work surface produced by such shaping processing.

Figure 1:
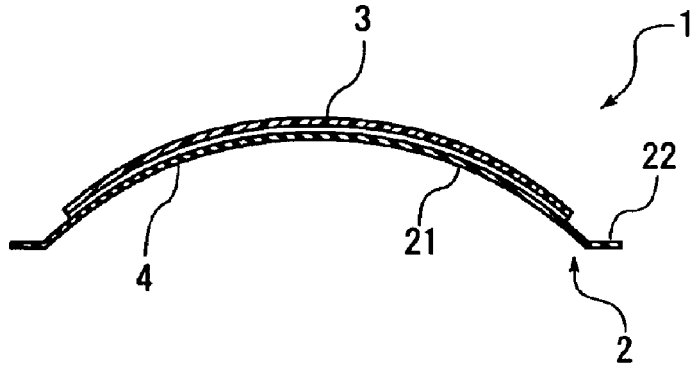
FIG. 1 shows one embodiment of the polisher according to the present invention, in which FIG. 1(*a*) is a sectional view, and FIG. 1(*b*) is a top plan view.
Figure 1:
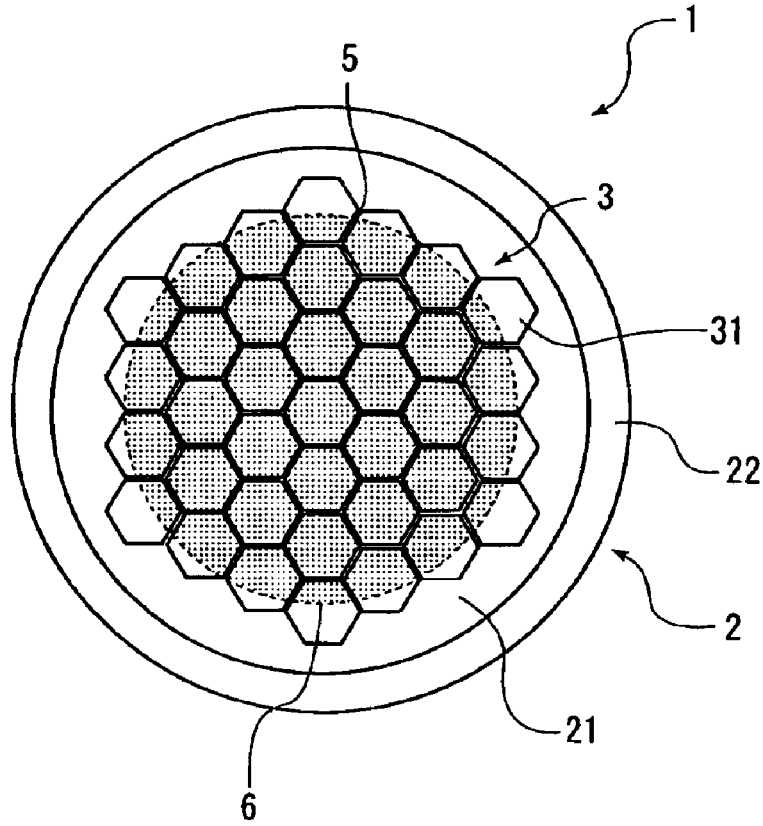
Figure 2:
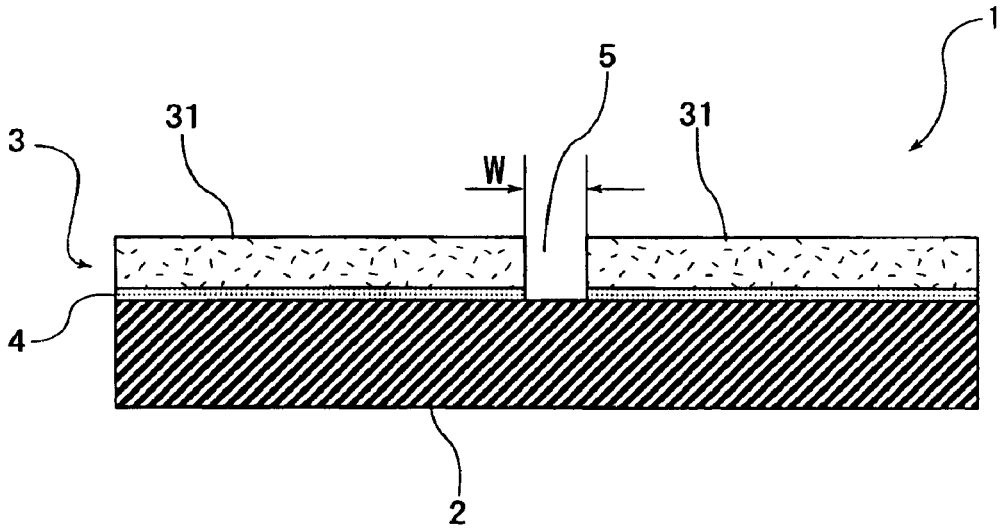
FIG. 2 is an enlarged sectional view of one embodiment of the polisher according to the present invention.

FIG. 1 shows the structure of one embodiment of the polisher according to the present invention, in which FIG. 1(*a*) is a sectional view, and FIG. 1(*b*) is a top plan view. FIG. 2 is an enlarged sectional view of the section of FIG. 1(*a*).

The polisher 1 has a structure in which a polishing pad 3 is adhered to the outside surface of an elastic base member 2 through a high-tack adhesive layer 4.

As shown in FIG. 1(*a*), the elastic base member 2 is composed of an elastic sheet, which comprises a dome-shaped portion 21 dome-like in shape, and a ring-shaped flange portion 22 provided integrally with the circumferential edge of the dome-shaped portion 21 and projected outwards. The polishing pad 3 comprises a plurality of regular hexagonal pads 31 the same in size and disposed with their sides close to each other so as to cover the surface of the elastic base member 2. The gaps between the pads 31 are water passing grooves 5 where the pad is absent, and the pads 31 are so adhered that the water passing grooves 5 have a predetermined width W. The water passing grooves 5 function as passages for supplying abrasive grains and water and discharging polishing chips. The water passing grooves 5 of the polishing pad 3 are communicated with each other from the vicinity of the center of the polishing pad 3 to end edges of the polishing pad 3. The formation region of the polishing pad 3 on the elastic base member 2 covers the moving region 6 of the work indicated by dots.

The elastic base member used for the polisher 1 according to the present invention preferably has a curved surface conforming to the shape of the work. For example, in the case of polishing the concave surface of a spectacle lens, the elastic base member is so shaped as to have the dome-shaped portion 21 shown in FIG. 1(*a*). As shown in FIG. 1(*a*), an example of the dome-shaped portion 21 is an elastic sheet formed in the dome-like shape, which shape is maintained by the inside pressure provided by use of a pressure fluid. Other examples include an elastic blank material formed into a dome-shaped block, and a dome-shaped elastic sheet of which the hollow portion is filled with other elastic blank material. The thickness of the elastic sheet is preferably 0.1 to 10 mm, particularly 0.2 to 5 mm. The elastic sheet preferably has a JIS A hardness (type A durometer) of 10 to 100, and a Young's modulus of $10^2$ to $10^3$ $N \cdot cm^{-2}$. Examples of the material of the elastic sheet and the elastic blank material include rubbers such as natural rubber, nitrile rubber, chloroprene rubber, styrene-butadiene rubber (SBR), acrylonitrile-butadiene rubber (NBR), silicone rubber, fluoro-rubber, etc., thermoplastic resins such as polyethylene, nylon, etc., and thermoplastic resin elastomers based on styrene, urethane, etc.

It is desirable that the diameter of the dome-shaped portion 21 of the elastic base member 2 is 1.1 to 10 times, preferably about 1.5 to 5 times, the diameter of the lens which is the work to be polished. By setting the size of the elastic base member 2 to be greater than the size of the work to be polished, it is possible to enhance the circumferential velocity, to enhance the polishing speed and to enhance the shape follow-up property of the elastic base member 2.

Figure 6:
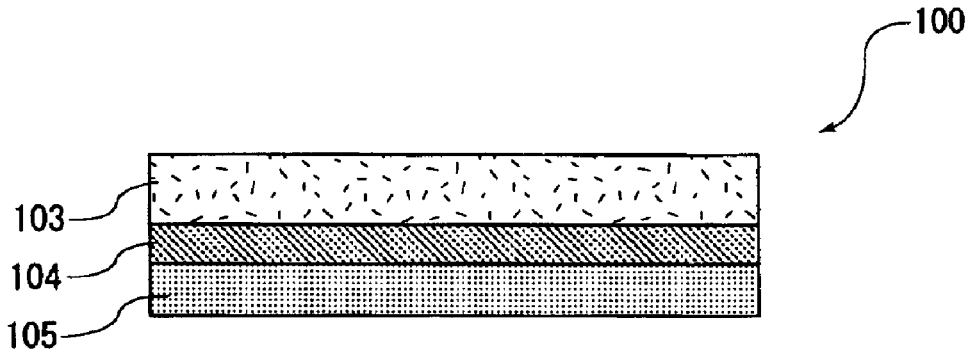
FIG. 6 is a sectional view showing the structure of a commercially available polishing pad.

Examples of the polishing pad 3 include fabrics such as felt, non-woven fabric, etc., sheets composed of a porous blank material made of polyurethane or the like, and synthetic resin sheets flocked with short fibers. In addition, commercially available polishing pads may also be used. A polishing pad 100 for use with a hard polishing dish which is commercially available has a structure in which a primer layer 104 and, further, a low-tack adhesive layer 105 are laminated on one side of a non-woven fabric 103, as shown in FIG. 6. Though not shown in FIG. 2, in the case of using a commercially available polishing pad, the primer layer 104 and/or the low-tack adhesive layer 105 shown in FIG. 6 is intermediately provided between a high-tack adhesive layer 4 and the polishing pad 3. In this case, a polishing pad composed of the non-woven fabric 103 provided only with the primer layer 103 or the low-tack adhesive layer 105 may also be used. Incidentally, the primer layer 104 is called a binder layer in some cases.

The shape of the polishing pad may be any one that enables the polishing pad to be adhered to the dome-shaped portion 21. On the other hand, the width W of the water passing grooves 5 provided in the polishing pad adhered onto the elastic base member 2 must be 0.1 to 5 mm, preferably 0.2 to 3 mm. The width W of the water passing grooves 5 in such a range must be maintained over the entire part of the polishing pad 3. By setting the width W of the water passing grooves 5 at such a small value, it is possible to restrain the deformation due to the comparatively lower stiffness of the elastic base member 2 at portions where the pad 31 is absent. As a result, while the function of the water passing grooves 5 is maintained, the fear of stripping of the polishing pad 3 by the circumferential edge of the lens is eliminated, and generation of defective polish due to stripping of the polishing pad 3 can be prevented. Since the water passing grooves 5 function as the above-mentioned passages, it is desirable that the water passing grooves 5 are communicated with each other over the range from the ends to the central area of the polishing pad 3.

In order to reduce the width of the water passing grooves 5 of the polishing pad 3 adhered to a curved surface, it is effective to compose the polishing pad of a plurality of pads and to form the water passing grooves at the gaps between the pads.

For example, pads polygonal in shape, such as triangular, heptagonal, pentagonal, hexagonal, etc. in shape are used, and one kind or a combination of two or more kinds of the polygonal pads are densely arranged with their sides close to each other to form the polishing pad, whereby the water passing grooves can be formed with a small width. The polygonal pads can be produced, for example, by cutting polygonal pads from a pad supplied in a roll form. As shown in FIG. 1(*b*), a plurality of regular hexagonal pads 31 the same in size may be arranged with their sides close to each other so as to cover the surface of the elastic base member 2, thereby forming the polishing pad 3. In addition, a combination of pentagonal pads and hexagonal pads, as in the case of a soccer ball, is also effective.

Figure 3:
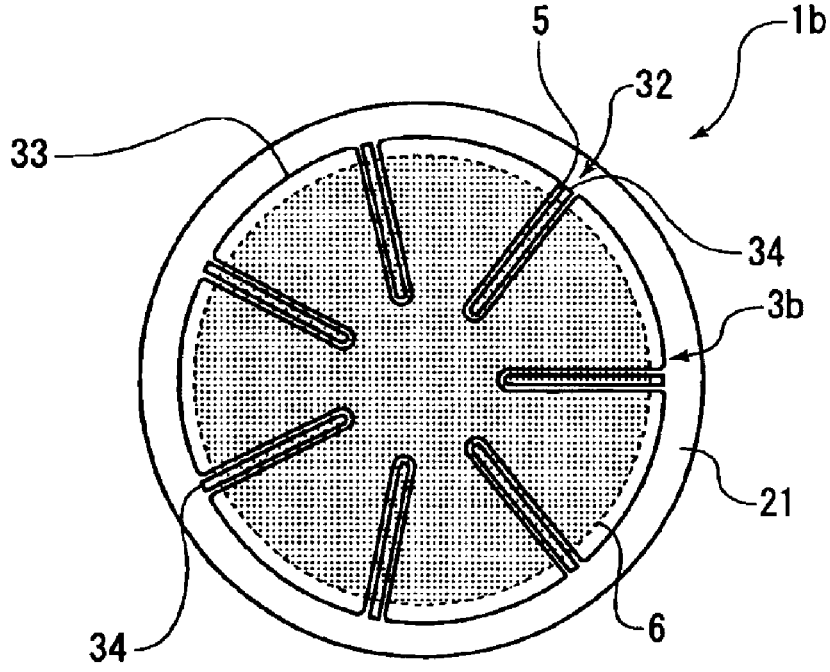
FIG. 3 is a top plan view of another embodiment of the polisher according to the present invention.

In addition, a polishing pad 3*b* as used in a polisher 1*b* shown in FIG. 3 may be mentioned as an example. The polishing pad 3*b* is composed of a petal-shaped pad 33 having wide notch portions 32 and elongate pads 34 so disposed as to partially fill the notch portions 32, and is adhered to the outside surface of a dome-shaped portion 21. Water passing grooves 5 are formed as gaps between the notch portions 32 provided in the petal-shaped pad 33 and the elongate pads 34 disposed in the notch portions 32.

Figure 5:
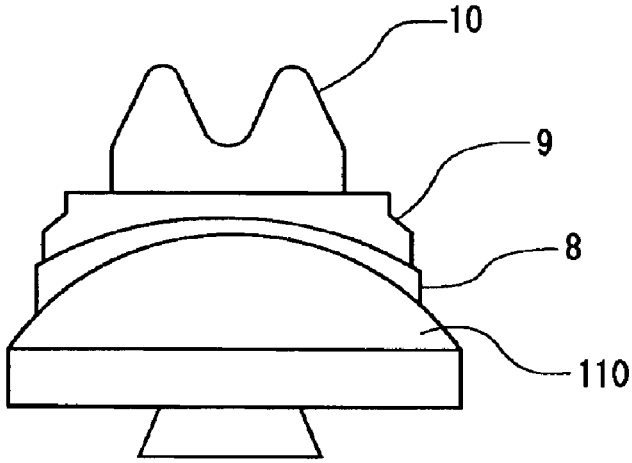
FIG. 5(*a*) is a general side view showing the condition where a concave surface of a lens is polished by use of a hard polishing dish, and FIG. 5(*b*) is a top plan view of the polishing dish.
Figure 5:
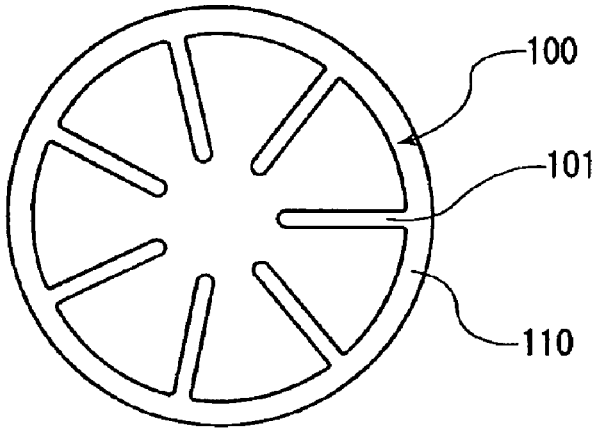
Figure 7:
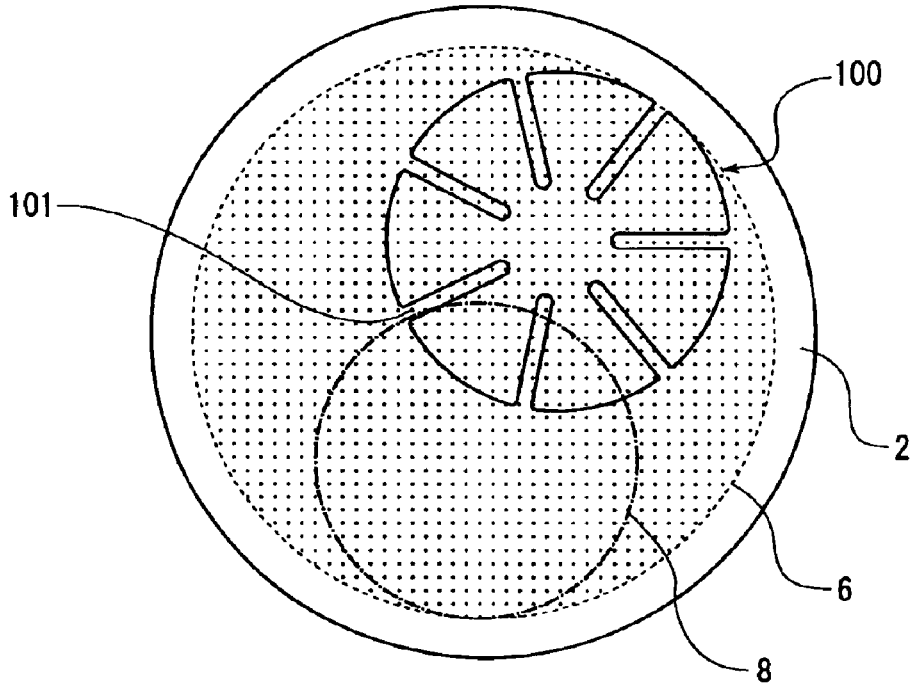
FIG. 7 is a top plan view showing the condition where the commercially available polishing pad is adhered to an elastic base member.

Besides, the pads are not limited to the polygonal pads and the pads for partially filling the notch portions, and may be pads for partially filling the gaps between the pads. Further, the petal-shaped pads 100 as shown in FIGS. 5 and 7 can be used if the width of the water passing grooves 101 can be set small.

The region where the polishing pad 3 is provided on the surface of the elastic base member 2 is preferably so set as to cover at least the region 6 where the work is brought into a rubbing motion at the time of polishing the work, as shown in FIGS. 1(*b*) and 3. For example, the polishing pad 3 is provided on the elastic base member 2 so that the work surface of the work does not come out of the polishing pad 3 even where the work is brought into an oscillating motion. By this, the risk of the turning-up of the end edge of the polishing pad 3 by the circumferential edge of the lens is eliminated, and a stripping preventive effect is further enhanced.

It is desirable that the high-tack adhesive layer 4 used in the polisher 1 according to the present invention has, for example, a tack in terms of 180° peel strength according to JIS Z 0237 of equal to or more than 1000 g/25 mm, preferably equal to or more than 1200 g/25 mm, most preferably equal to or more than 1500 g/25 mm. By use of a high-tack adhesive, the adhesive force between the polishing pad 3 and the elastic base member 2 is enhanced, and the polishing pad 3 will not easily be stripped.

The adhesive 105 used for the polishing pad 100 for the hard polishing dish 110 according to the prior art is based on the presumption of use by adhering to the hard polishing dish, so that the adhesive force is set to be low taking into account the workability at the time of stripping and the residue of adhesive, and is of a low-tack type similar to the re-stripping type. The tack of the conventional adhesive in terms of 180° peel strength according to JIS Z 0237 is about 750 to 880 g/25 mm.

Incidentally, the general measuring method of 180° peel strength according to JIS Z 0237 is as follows. A half-length portion of a test piece of 25 mm in width by about 250 mm in length is adhered to a cleaned stainless steel plate by use of a roller having a mass of 2000±50 g, the test piece is folded back by 180°, and is peeled at a rate of 300±30 mm/min to read the force required, under a test temperature of 23±2° C. and a relative humidity of 65±5%.

The high-tack adhesive 4 is desirably a double-faced adhesive tape, taking into account the adhesive property and workability. Examples of the base of the double-faced adhesive tape include non-woven fabric, Japanese paper, polyethylene foam, polypropylene film, polyester film, etc. The kind of the adhesive is not particularly limited, as far as the adhesive has the above-mentioned tack. Examples of the adhesive which can be used include rubber-based adhesives such as adhesives based on natural rubber, SBR, regenerated rubber, or the like, and acrylic-based adhesives.

Next, a method of polishing the concave surface of a spectacle lens as a work by use of the polisher 1 shown in FIG. 1 will be described referring to FIG. 4.

The polisher 1 is fitted to a fitting jig 7, to be used as a polishing tool. The fitting jig 7 holds the polisher 1, forms the inside surface side of the polisher 1 as a sealed space, and functions as a passage for introducing a pressure fluid to the inside of the polisher 1. Further, the fitting jig 7 has the function of fixing the polisher 1 by fitting to a polishing apparatus which is not shown.

The fitting jig 7 comprises a fitting jig main body 71 and a ring-shaped presser member 72. The fitting jig main body 71 comprises a cylinder-shaped tubular portion 711, and a flange-shaped polisher fitting portion 712 provided integrally with an outer circumferential portion of a top end portion of the tubular portion 711, projected in directions orthogonal to the axis of the tubular portion 711, and coaxial with the tubular portion 711. The presser member 72 has a flat lower surface and is ring-shaped with an outer circumference substantially the same as the outer circumference of the polisher fitting portion 712. At a lower end portion of the tubular portion 711, a tapered fitting portion 713 for fixing by fitting to the polishing apparatus is projected outwards.

In order to fix the polisher 1 to the fitting jig 7, the flange portion 22 of the polisher 1 is mounted on the polisher fitting portion 712, the presser member 72 is mounted on the flange portion 22 of the polisher 1, and thereafter the presser member 72 and the polisher fitting portion 712 are fixed by bolts or the like which are not shown, whereby the flange portion 22 of the polisher 1 is fixed by clamping between the polisher fitting portion 712 and the presser member 72. As a result, a dome-shaped sealed space 23 is formed between the inside surface of the dome-shaped portion 21 and the upper surface of the polisher fitting portion 712, and the sealed space 23 is communicated with the exterior through the hollow portion of the tubular portion 711.

To the convex surface of the work 8 to be polished is joined a work fitting portion 10 fixed by fitting to a chuck of the polishing apparatus through a joining member 9, for example, a low melting point metal, a wax or the like. The chuck of the polishing apparatus not shown is driven to rotate, and the work 8 is rotated about its axis at a predetermined rotational speed. In addition, an air pressure, for example, is exerted on the chuck so that the work 8 can be pressed against the polisher 1 at a predetermined polishing pressure. Further, the chuck for supporting the work 8 of the polishing apparatus is brought into an oscillating motion such that the rotational axis of the work 8 reciprocates between the vicinity of the apex and an end portion side of the dome-shaped portion 21.

Figure 4:
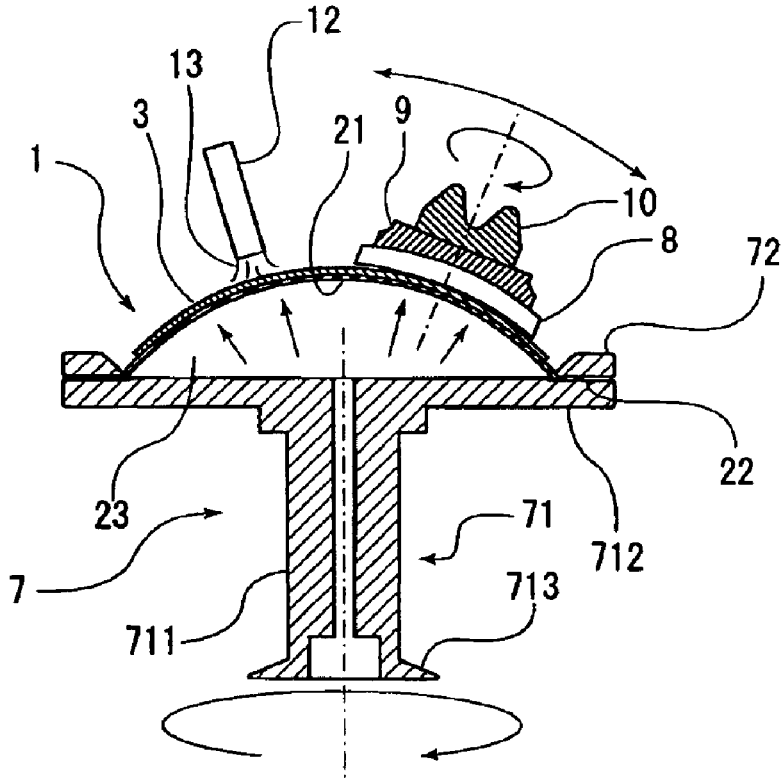
FIG. 4 is a sectional view showing a method of polishing a concave surface of a lens by use of one embodiment of the polisher according to the present invention.

At the time of polishing, as shown in FIG. 4, the polisher 1 is fitted to a turntable of the polishing apparatus which is not shown, through the fitting jig 7. A fluid such as water, compressed air and the like at a predetermined pressure is fed into the sealed space 23 between the inside surface of the dome-shaped portion 21 and the polisher fitting portion 712, and the inside of the sealed space 23 is maintained at a predetermined pressure, whereby the inside surface of the dome-shaped portion 21 is pressed and tightened by the pressure fluid. In addition, rotation is performed with the center axis of the tubular portion 711 of the fitting jig 7 as a rotational axis. Then, polishing is conducted by rotating the elastic polisher 1 about its axis at a predetermined rotational frequency while swelling the elastic polisher 1 by a predetermined inside pressure, pressing the work 8 against the elastic polisher 1 by a predetermined polishing pressure while rotating the work 8 about its axis at a predetermined rotational frequency, bringing the work 8 into an oscillating motion, and supplying an abrasive-containing slurry 13 from a nozzle 12 to the surface of the elastic polisher 1.

According to such a polishing method, the circumferential edge of the lens 8 can be effectively prevented from getting between the polishing pad 3 and the elastic base member 2, because the polishing pad 3 is adhered to the elastic base member 2 through the high-tack adhesive layer 4, the width of the water passing grooves 5 provided in the polishing pad 3 is small, and the polishing pad 3 covers the moving region 6 of the work 8. Therefore, the polishing pad 3 would not easily be stripped from the elastic base member 2, generation of defective polish due to stripping can be restrained, and polishing can be performed with high yield.

While an example of polishing the concave surface of a lens has been shown in the above description, the polisher according to the present invention is applicable also to polishing of a flat surface and a convex surface.

EXAMPLE

Now, the case of polishing and mirror surface finishing a plastic spectacle lens whose convex surface side has been optically finished by a mold and whose concave surface side has been cut to a desired curved surface shape, by use of the polisher according to the present invention will be described as an example.

First, a desired semi-finished lens is formed through the step of molding a plastic spectacle lens, in the same manner as in the prior art. Next, the semi-finished lens thus molded is adhered to the work fitting portion 10 through the joining member 9, and subsequently the concave surface of the semi-finished lens is cut to a shape conforming to the prescription for the customer by a cutting step. In this example, a semi-finished lens (hereinafter referred to as work 8) shaped to a spherical surface with a radius of curvature of 109.09 mm by cutting was fitted to the polishing apparatus. The polishing apparatus is fitted with a polisher 1 having a structure in which a polishing pad composed of a non-woven fabric provided with a primer layer and a low-tack adhesive layer is held on the surface of an elastic base member 2 composed of an elastic sheet through a high-tack adhesive layer 4. The polishing pad is the polishing pad 3*b* shown in FIG. 3, which is present over the entire area of the region 6 where the work 8 is brought into a rubbing motion at the time of polishing.

As the polishing pad 3*b*, a non-woven fabric type polishing pad available under a commercial name of Blue Pad, a product by 3M, was used. As the high-tack adhesive layer, a double-faced adhesive tape available under the code number #595 (the base is Japanese paper; having an acrylic-based pressure sensitive adhesive layer, with a tack of 1000 g/25 mm), a product by Sekisui Chemical Co., Ltd. was used. As the elastic base member 2, a nitrile rubber member having a hollow shape obtained by cutting a part of a sphere with a radius of curvature of 80 mm and having a thickness of 3 mm and a JIS A hardness (type A durometer) of 60 was used.

As shown in FIG. 4, the shape of the elastic base member 2 was controlled by supplying compressed air at a pressure of 0.6 kgf/cm$^2$ to the inside of the elastic base member 2. A dielectric liquid 13 containing an abrasive dispersed therein was supplied from a nozzle 12 to the portion between the work 8 and the polisher 1. As the abrasive, $Al_2O_3$ with a mean particle diameter of 1.2 $\mu$m was used.

Under these conditions, polishing was conducted for about 8 min by rotating the work 8 and the elastic polisher 1 at respective speeds of 10 rpm and 300 rpm, setting both of them into relative oscillation by a motion mechanism which is not shown, and applying a polishing pressure of 15 kgf by a pressurizing means which is not shown.

Ten works 8 were polished under the same conditions. Polishing was completed without the trouble that a circumferential edge portion of the work 8 would get between the polishing pad 3*b* and the elastic polisher 1, namely, without stripping of the polishing pad 3*b*, and a desired optical surface could be obtained with each of the ten works 8.

As has been described above, the polisher according to the present invention ensures that the polishing pad adhered to the elastic base member would not easily be stripped during polishing, generation of defective polish due to stripping of the polishing pad can be prevented, and polishing can be performed with high yield.

In addition, according to the polishing method of the present invention, the polisher such that the polishing pad adhered to the elastic base member would not easily be stripped during polishing is used, so that generation of defective polish due to stripping of the polishing pad can be prevented, and polishing can be performed with high yield.

INDUSTRIAL APPLICABILITY

The polisher according to the present invention is suitable, particularly, for smoothing or mirror surface finishing after cutting of a concave surface of a spectacle lens or the like.

Besides, the polishing method according to the present invention is suitable for smoothing or mirror surface finishing after cutting of a concave surface of a spectacle lens or the like, by use of the polisher.

Explanation of Symbols

1, 1*b*: polisher; 2: elastic base member; 21: dome-shaped portion; 22: flange portion; 3, 3*b*: polishing pad; 31, 33, 34: pad; 4: high-tack adhesive; 5: water passing groove; 6: moving region of work; 7: polisher fitting jig; 8: work (lens); 9: joining member; 10: work fitting portion.

What is claimed is:

1. A polisher comprising:

a polishing pad which is adhered to a surface of an elastic base member through a high-tack adhesive layer having a 180° peel strength of equal to or more than 1000 g/25 mm, the polishing pad comprising water passing grooves having a width of 0.1 to 5 mm.

2. A polisher as set forth in claim 1, wherein said polishing pad is provided with a plurality of pads, and said water passing grooves are formed between said plurality of pads.

3. A polisher as set forth in claim 2, wherein said pads are polygonal in shape.

4. A polisher as set forth in claim 2, wherein said polishing pad is comprised of a pad having notch portions and pads disposed in said notch portions.

5. A polisher as set forth in claim 1, wherein said polishing pad is provided on said elastic base member so as to cover at least the region where a work to be polished is brought into a rubbing motion during polishing of said work.

6. A polisher as set forth in claim 1, wherein a primer layer and/or a low-tack adhesive layer is intermediately provided between said high-tack adhesive layer and said polishing pad.

7. A polisher as set forth in claim 1, wherein said high-tack adhesive layer is a double-faced adhesive tape.

8. A polisher as set forth in claim 1, wherein said elastic base member has a curved surface shape.

9. A polisher as set forth in claim 1, wherein said elastic base member is provided with an elastic sheet.

10. A polisher wherein a polishing pad is adhered to a surface of an elastic base member through a high-tack adhesive layer having a 180° peel strength according to JIS Z 0237 of equal to or more than 1000 g/25 mm.

11. A polisher as set forth in claim 10, wherein said polishing pad is adhered so as to cover at least the region where a work to be polished is brought into a rubbing motion during polishing of said work.

12. A polisher as set forth in claim 10, wherein said elastic base member is comprised of an elastic sheet having a curved surface shape.

13. A polishing method comprising:

polishing a work to be polished by pressing a polishing pad of a polisher against a work surface of said work, said polisher having said polishing pad adhered to a surface of an elastic base member through a high-tack adhesive layer having a 180° peel strength of equal to or more than 1000 g/25 mm, and said polishing pad comprising water passing grooves having a width of 0.1 to 5 mm.

14. A polishing method as set forth in claim 13, wherein polishing is conducted while pressing an inside surface of said elastic base member which is comprised of an elastic sheet and dome-shaped by a pressure fluid.

15. A polishing method as set forth in claim 13, wherein said work is oscillated while said polisher and said work are rotated respectively about their axes.

16. A polishing method as set forth in claim 13, wherein said polishing pad is provided with a plurality of pads, and said water passing grooves are formed between said plurality of pads.

17. A polishing method as set forth in claim 16, wherein said pads are polygonal in shape.

18. A polishing method as set forth in claim 16, wherein said polishing pad is provided with a pad having notch portions and pads disposed in said notch portions.

19. A polishing method as set forth in claim 13, wherein said polishing pad is provided on said elastic base member so as to cover at least the region where said work is brought into a rubbing motion during polishing of said work.

* * * * *